United States Patent [19]

Laguilharre

[11] Patent Number: 4,505,645

[45] Date of Patent: Mar. 19, 1985

[54] PROCESS AND INSTALLATION FOR RAPIDLY CREATING A HIGH VACUUM USING A SINGLE STAGE LIQUID RING PUMP

[76] Inventor: Pierre R. Laguilharre, 6, rue Robin, 95880 Enghien les Bains, France

[21] Appl. No.: 347,430

[22] Filed: Feb. 10, 1982

[30] Foreign Application Priority Data

Feb. 13, 1981 [FR] France ..... 81 02929

[51] Int. Cl.[3] ..... F04C 19/00

[52] U.S. Cl. ..... 417/69; 47/77; 47/80

[58] Field of Search ..... 417/53, 54, 62, 69, 417/77–80, 244

[56] References Cited

U.S. PATENT DOCUMENTS

| | | | |
|---|---|---|---|
| 2,492,075 | 12/1949 | Van Atta | 417/62 X |
| 2,599,701 | 6/1952 | Eames | 417/62 |
| 3,221,659 | 12/1965 | Adams | 417/69 |
| 3,228,587 | 1/1966 | Segebrecht | 417/62 |
| 3,239,131 | 3/1966 | Whyte | 417/69 X |
| 3,420,181 | 1/1969 | Berry | 417/80 |
| 3,575,532 | 4/1971 | Mugele | 417/69 |

*Primary Examiner*—Edward K. Look

*Attorney, Agent, or Firm*—Warren B. Kice

[57] ABSTRACT

An installation for rapidly obtaining a high vacuum, comprising two compression stages, the first of which is a liquid ring vacuum pump, characterized in that means are provided for instantaneously coupling or dissociating the first stage and the second stage. The invention concerns also a process intended to be used in said installation.

13 Claims, 4 Drawing Figures

A
B
1
2
3
4
5
6
7
8
9
10,10a
11
12
13
14
15
15a
15b
16
17
18
19
20
21
22
23
24
25
26
27
28
29
30

PROCESS AND INSTALLATION FOR RAPIDLY CREATING A HIGH VACUUM USING A SINGLE STAGE LIQUID RING PUMP

The present invention relates to a process and an installation for rapidly creating a high vacuum using two compression stages, the first of which is formed by a liquid ring vacuum pump.

It is known that single stage liquid ring vacuum pumps allow compression rates of about 9 to be reached without appreciably lowering the displacement capacity. On the other hand, higher compression rates can only be obtained with a substantial drop in the displacement capacity and so of the efficiency of these vacuum pumps.

To remedy these drawbacks, use is more especially known of a two stage liquid ring pump or a single stage liquid ring pump associated with a vapor ejector disposed upstream of this pump.

However, although high compression rates can be obtained with these devices and installations, they present other disadvantages.

Thus, in the case of associating a single stage liquid ring vacuum pump and an upstream vapor ejector, the evacuation is very slow for equal consumption of energy with respect to the evacuation obtained with a two staage liquid ring vacuum pump. The energy consumed in operation after evacuation is also high.

In the case of two stage liquid ring vacuum pumps, the evacuation is faster than in the preceding case but the performances relative to the speed of this evacuation still remain insufficient. This insufficiency results in a reduction of the effective work in particular in vacuum installations requiring numerous intermittent evacuations. On the other hand, the respective compression rates at the two stages are unalterable and cannot undergo an immediate change which would allow better adaptation either during the evacuation or in continuous operation. Furthermore, it is difficult to obtain correct cumulative axial clearances which, for this reason, deteriorate in time with a consequent lowering of efficiency. Finally, the cooling water flow-rate of these pumps cannot undergo separate high or rapid variations which would allow the efficiency to be improved. The present invention has then as its aim to remedy all the above-mentioned drawbacks, while keeping the main advantages mentioned above. For this, it proposes a process which is characterized in that it consists in creating first of all an intermediate vacuum by using a first compression stage formed by a liquid ring vacuum pump, then, once this intermediate vacuum has been reached, in continuing the evacuation by coupling a second compression stage in series wih the first stage, the intermediate vacuum corresponding preferably to the best vacuum which can be obtained with the first stage with optimum efficiency.

The present invention also relates to an installation of the type defined in the first paragraph of the present description and which is characterized in that means are provided for instantaneously coupling together or dissociating the first stage and the second stage.

According to a first variation of the invention, the second stage is formed by a liquid jet ejector whose drive liquid input is connected to the delivery side of a centrifugal pump fed with this liquid. To show the advantages provided by the installation according to this first variation of the invention, we will compare below its performances with those of a two stage liquid ring vacuum pump which is one of the most used devices for obtaining high compression rates.

It should first of all be recalled that the power consumed by a two stage liquid ring vacuump pump is given by the formula:

$$W=(0.981/a)\times P_1V_1\times \text{Napierian log } (P_2/P_1)$$

in which:

W designates the power consumed expressed in watts $P_1$ designates the absolute pressure at the suction side expressed in Pascals $V_1$ designates the suction volume expressed in $m^3/s$ $P_2$ designates the absolute delivery pressure expressed in Pascals $(P_2/P_1)$ designates the compression rate, and a designates a parameter depending more especially on the vacuum obtained and the heat discharged (0.20 on average).

It should be noted that in a two stage liquid ring vacuum pump, the product $P_1V_1$ is a constant and consequently the power consumed at each stage is proportional to the Napierian logarithm of the respective compression rates of each stage.

Let us suppose by way of example that it is desired, with a two stage liquid ring vacuum pump, to evacuate an air volume of 0.055 $m^3/s$ at an absolute pressure of $8.333\times10^3$ Pa so as to discharge it at atmospheric pressure ($100\times10^3$ Pa), i.e. with a total compression rate of $(100/8.333)=12$.

Let us suppose that the compression rates are equal in each stage, i.e. $\sqrt{12}=3.46$ giving an intermediate vacuum at the output of the first stage of $28.867\times10^3$ Pa.

Calculation with the above formula gives an effective total power consumption of 5700 watts, i.e. a power consumption of 2850 watts for each stage.

If, in accordance with the first variation of the present invention, the second stage of the two stage liquid ring pump is replaced by a water jet injector whose operation is ensured by the pressurized water coming from the discharge side of a centrifugal pump having an efficiency of about 0.75, the result will be that, for delivering from $28.867\times10^3$ Pa to $100\times10^3$ Pa, the water jet ejector will have to have a water flow rate of about 0.0075 $m^3/s$ at a pressure of $275\times10^3$ Pa.

The effective power consumption by the ejector will be about 2800 watts, i.e. substantially the effective power consumed by the second stage of the liquid ring vacuum pump.

However, and in accordance with the invention, it is possible at the beginning of evacuation of the installation, by the use of means provided for this purpose, to dissociate the liquid jet injector and the liquid ring vacuum pump, i.e. to dissociate the first compression stage from the second compression stage, and thus to provide evacuation only in the first compression stage until a vacuum is reached which can be obtained with maximum efficiency (generally close to $24\times10^3$ Pa). Thus, and for equal power consumption, the evacuation in the first stage of the installation in accordance with the invention is approximately 20% faster than the evacuation in the first stage of a two stage liquid ring vacuum pump. Once the vacuum of about $24\times10^3$ Pa has been reached (vacuum which we will call hereafter coupling point of the liquid jet ejector) and in accordance with the invention, the liquid jet ejector is coupled to the single stage liquid ring vacuum pump and from then on the speed of evacuation and the power consumed link up again with the characteristics of the two stage liquid ring pump.

This gain of 20% in the speed of evacuation is an obvious advantage since it allows, with respect to the devices of the prior art, an improved effective use of the installation, this being all the more significant in installations which operate discontinuously and accordingly require frequent evacuations.

The means for instantaneously coupling together or dissociating the liquid jet ejector and the single stage liquid ring vacuum pump will comprise for example a device for adjusting the flow-rate, such as a valve, disposed at the drive liquid input of the liquid jet ejector or in the delivery duct of the centrifugal pump. The regulation of the flow-rate to zero, i.e. the closure of the valve, corresponds to the dissociation of the two stages of the installation, whereas opening of this valve amounts to associating these two stages.

Instead of, or preferably in addition to, this flow-rate regulating device, the means in accordance with the invention for coupling together or dissociating the two stages of the installation may comprise a device for connecting, preferably automatically, the centrifugal pump with the vacuum created by the liquid ring vacuum pump, when this vacuum reaches a predetermined value, this predetermined value corresponding to the optimum vacuum able to be created by the first stage alone with optimum efficiency. So, as long as this value is not reached, the centrifugal pump remains unprimed; during the evacuation of the first stage, the liquid jet ejector is then inoperative and so dissociated from the first stage. On the other hand, as soon as the predetermined vacuum is reached, the centrifugal pump is connected with the vacuum created and so this latter is primed and the liquid jet ejector is brought into operation, so association of this latter with the first stage.

Furthermore, the fact of dissociating the two stages during the evacuation, particularly with the means which have just been described, limits the power consumed by the installation during the evacuation.

Moreover, if the desired vacuum may be obtaind with optimum efficiency, i.e. with a relatively low compression rate (less than 9) by using only the first stage, namely of the liquid ring pump, it is obvious that there is no point in causing the liquid jet ejector to function; the means for automatically connecting the centrifugal pump with the vacuum created by the liquid ring pump will be then adjusted so that they are inoperative at this value of the vacuum. Thus, this centrifugal pump will not be primed and it will remain inoperative.

Still with reference to the first variation of the invention, it is particularly advantageous for said means for instantaneously coupling together or dissociating the first and second stages, to comprise an instantaneous opening or closing shut-off valve, preferably automatic, disposed in the duct connecting the delivery side of the first stage to the suction side of the second stage, a first non-return valve disposed in a by-pass opening into the free air and connected to said duct upstream of the shut-off valve and a second non-return valve disposed in piping extending from the suction side of the first stage and joining up with the suction side of the second stage downstream of the shut-off valve, the second non-return valve only allowing fluids to flow in the direction from the first stage to the free air, the second non-return valve only allowing fluids to flow in the direction from the suction side of the first stage to the suction side of the second stage, these two non-return valves opening when the shut-off valve closes and closing when the shut-off valve opens.

This particular arrangement allows in fact up to the coupling point, not only dissociation of the liquid jet ejector from the liquid ring pump (result produced by the shut-off valve when it is closed), but also the evacuation to be accelerated in a high proportion (about 30%) with only a slight over consumption of power and this, by parallel coupling of the two stages (result produced by the two non-return valves when they are open). On the instantaneous opening of the shut-off valve, the non-return valves close instantaneously and the two stages are coupled in series.

In accordance with the present invention, the liquid jet ejector may be of the single nozzle or of the multi-nozzle type. The nozzle(s) advantageously comprise means for adjusting their diameter and in the case of a multi-nozzle ejector, this latter comprises preferably means for reducing the number of said nozzles.

With these means, it is possible to adjust the vacuum at the level of the second stage to the desired value and to regulate the power consumption depending on the displacement capacity of the installation, thus avoiding useless over consumption of power.

Advantageously, the centrifugal pump is driven on the same shaft line as that of the liquid ring pump.

The centrifugal pump may in particular be driven by the same shaft as that of the liquid ring pump.

According to one of numerous possible embodiments, the centrifugal pump is mounted at the end of the shaft of the liquid ring pump, either directly or through a step-up gear or a speed variator.

It should be noted that the inside of the liquid ring pump may be in relation with a cooling liquid supply duct for avoiding or reducing the heating of said liquid ring pump.

The delivery side of the liquid ring pump will be preferably connected directly to the suction side of the liquid jet ejector. In this case, the water for cooling the liquid ring pump which is discharged simultaneously with the gas is introduced into the liquid jet ejector for automatically removing the excess heat. Furthermore, as will be seen hereafter, this discharged water may be used, for reasons of economy, after leaving the ejector, wholly or partly in the centrifugal pump.

Furthermore, the delivery side duct of the liquid jet ejector may open into a liquid-gas separator comprising means connected to the suction side duct of the centrifugal pump for returning all or part of the liquid collected in the separator to said centrifugal pump.

With an eye to economizing liquid, the separator may be formed by a tank with two compartments, one supplied with cooling liquid and connected to the cooling liquid supply duct, the flow of the cooling liquid supplying said compartment being greater than that of the cooling liquid in said supply duct, the other receiving on the one hand the liquid-gas mixture from the liquid jet ejector and, on the other hand, the overflow from the other compartment.

The liquid level in the compartment connected to the liquid ring pump will be preferably substantially above the liquid level in the compartment receiving the liquid-gas mixture from the liquid jet ejector. According to another embodiment, the cooling liquid supply duct may be connected to a continuous cooling liquid source, such as the water distribution network for example. In this case however, said duct is provided with a shut-off valve which closes or opens automatically respectively when the liquid ring pump stops or starts up; similarly, the delivery side of the centrifugal pump will be provided, upstream of the flow regulating device, with a by-pass formed by a duct having a diaphragm for letting a very low liquid flow to pass through this duct. This particular arrangement is advantageous during the evacuation when the centrifugal pump is in action and when the drive liquid input of the ejector is closed or when the delivery side duct of the centrifugal pump is closed; under these conditions there is in fact heating of the liquid of the centrifugal pump and the by-pass of the invention allows a fraction of the heat of the liquid to be discharged, this latter being then able to be replaced by cold liquid.

According to a second variation of the present invention the second compression stage is formed by a single stage liquid ring vacuum pump.

The advantages provided by this second variation with respect to known devices are substantially the same as those previously mentioned for the first variation.

Within the scope of this second variation, the liquid ring vacuum pump forming the first stage and the liquid ring vacuum pump forming the second stage may be driven by different motors. In this case, the means for instantaneously coupling together or dissociating the first stage and the second stage will comprise for example a first non-return valve disposed in the duct connecting the delivery side of the first stage to the suction side of the second stage and a second non-return valve disposed in a by-pass opening into the free air and connected to said duct upstream of the first non-return valve, this latter only allowing fluids to flow in the direction from the first stage to the second stage and the second non-return valve only allowing fluids to flow in the direction from the first stage to the free air.

The liquid ring vacuum pump forming the first stage and the liquid ring vacuum pump forming the second stage may also be driven by the same motor, in which case the means for instantaneously coupling together or dissociating the first and the second stage may comprise an instantaneous opening or closing shut-off valve, preferably automatic, disposed in the duct connecting the delivery side of the first stage to the suction side of the second stage and a non-return valve disposed in a by-pass opening into the free air and connected to said duct upstream of the shut-off valve, the non-return valve only allowing fluids to flow in the direction from the first stage to the free air, this same non-return valve opening when the shut-off valve closes and closing when the shut-off valve opens.

Finally, the means for instantaneously coupling together or dissociating the first and second stages may also be formed, whether the two liquid ring vacuum pumps are driven by the same motor or not, by an instantaneous opening and closing shut-off valve, preferably automatic, disposed in the duct connecting the delivery side of the first stage to the suction side of the second stage, a first non-return valve disposed in a by-pass opening into the free air and connected to said duct upstream of the shut-off valve and a second non-return valve disposed in a pipe extending from the suction side of the first stage and joining the suction side of the second stage downstream of the shut-off valve, the first non-return valve only allowing fluids to flow in the direction from the first stage to the free air, the second non-return valve only allowing fluids to flow in the direction from the suction side of the first stage to the suction side of the second stage, these two non-return valves opening when the shut-off valve closes and closing when the shut-off valve opens.

The means thus conceived are particularly advantageous since, at the beginning of evacuation, they allow the two liquid ring pumps to be instantaneously dissociated from each other and coupled together in parallel, which accelerates the evacuation in a high proportion.

Several embodiments of the present invention are described hereafter by way of examples with reference to the accompanying drawings in which.

Figure 3:
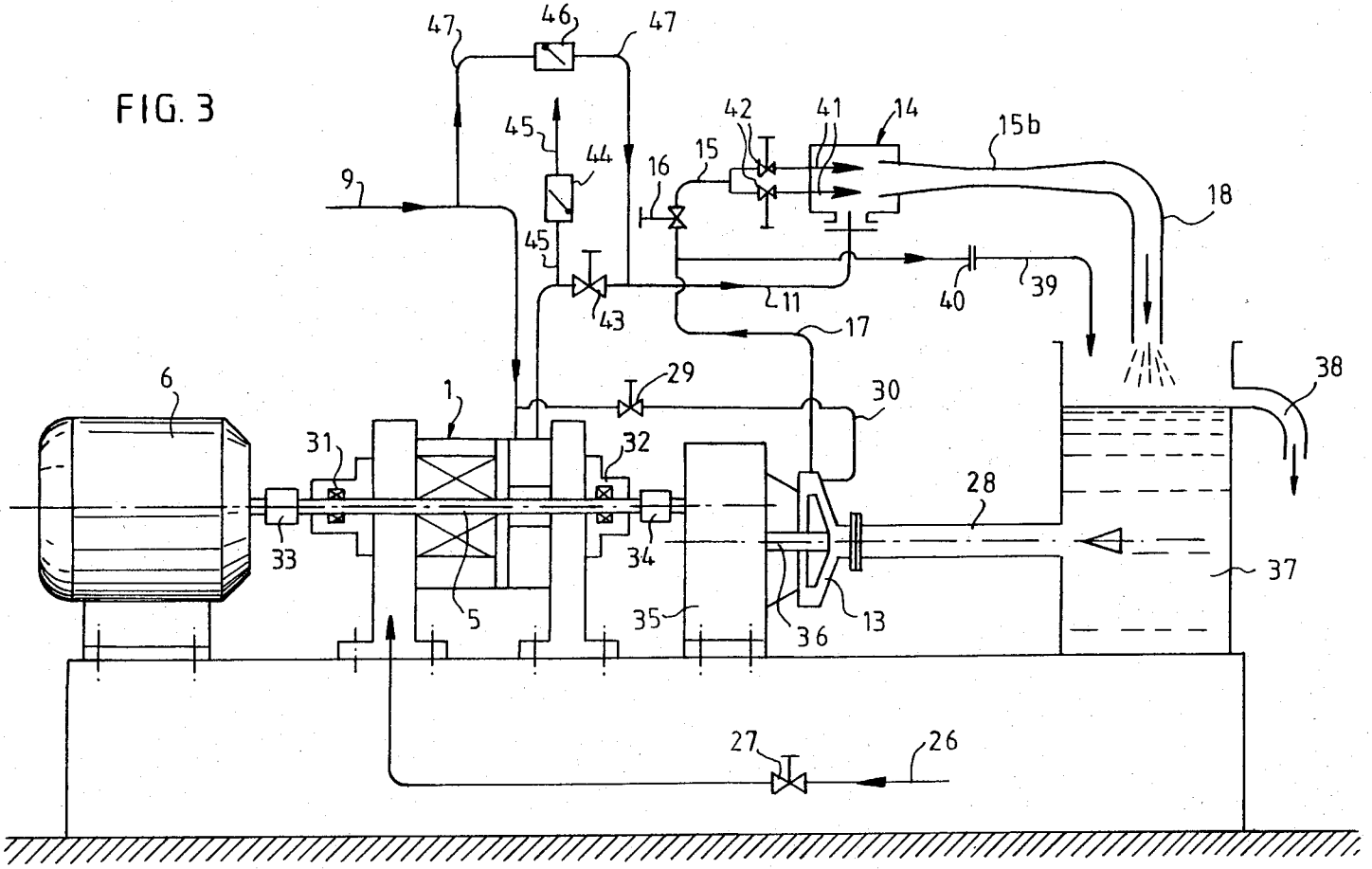
Figure 4:
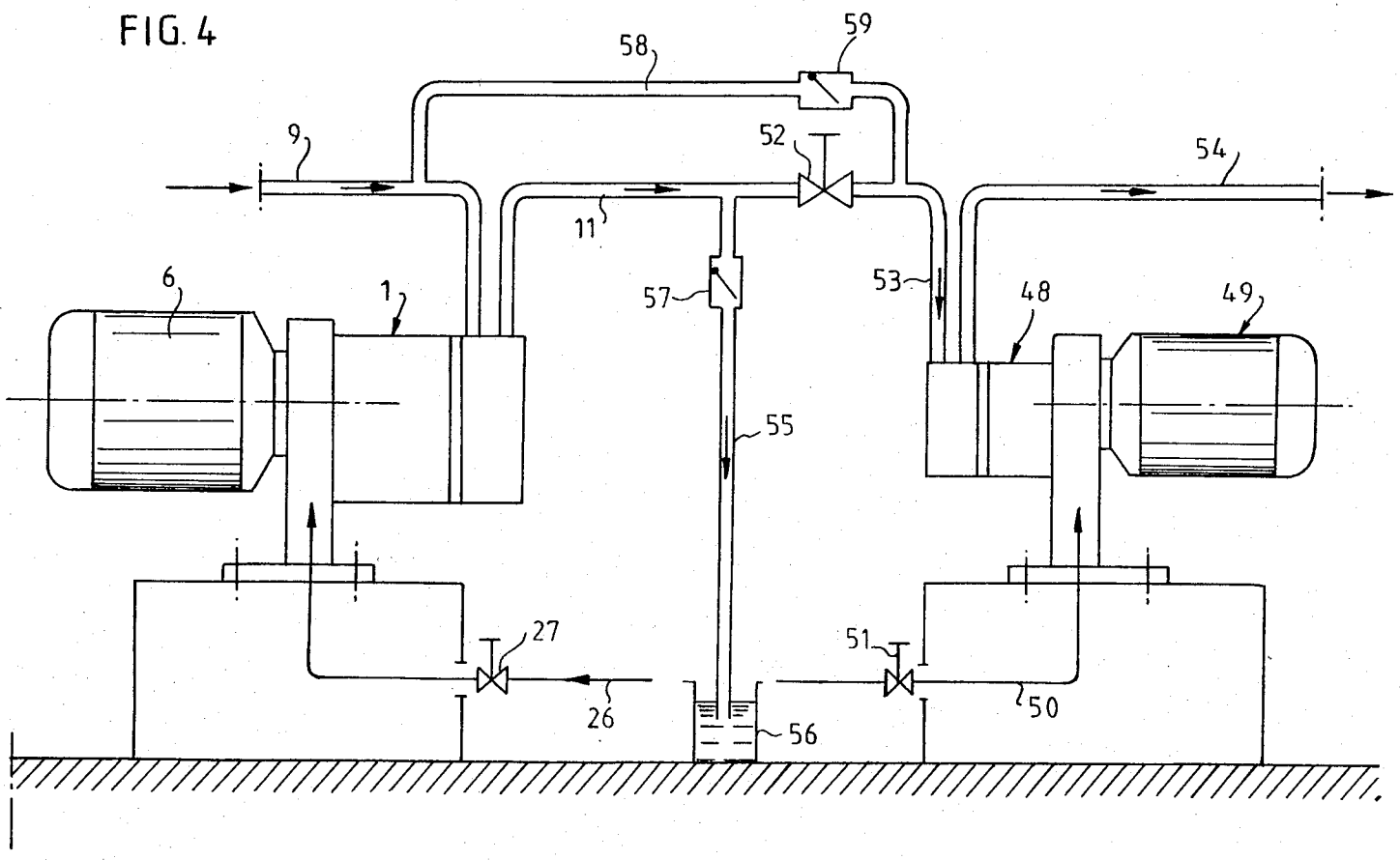

FIG. 3 is the schematical representation of a vacuum unit comprising a liquid ring vacuum pump (separate motor), this latter being mounted on double ball-bearings and the centrifugal pump being tail shaft mounted, said liquid ring pump and the ejector being able to be instantaneously coupled together in series or in parallel (first variation of the invention) and FIG. 4 is the schematical representation of a vacuum unit comprising two independent monobloc liquid ring vacuum pumps, being able to be instantaneously coupled together in series or in parallel (second variation of the invention).

A single stage liquid ring vacuum pump 1 comprises, in a way known per se, a cylindrical body 2 partially filled with water (or any other liquid of low volatility and low viscosity) and in which rotates a blade wheel 3 whose hub 4 is fitted on to an eccentric shaft 5 and rotated by a motor 6. This water, moved by the blade wheel 3, is projected against body 2 and forms a sort of ring 7 which defines a chamber 8 with hub 4.

The rotating blades move in this chamber 6 while defining spaces variable in volume, spaces the volume of which increase in zone A (right-hand zone) and diminishes in zone B (left-hand zone).

Figures 1, 2:
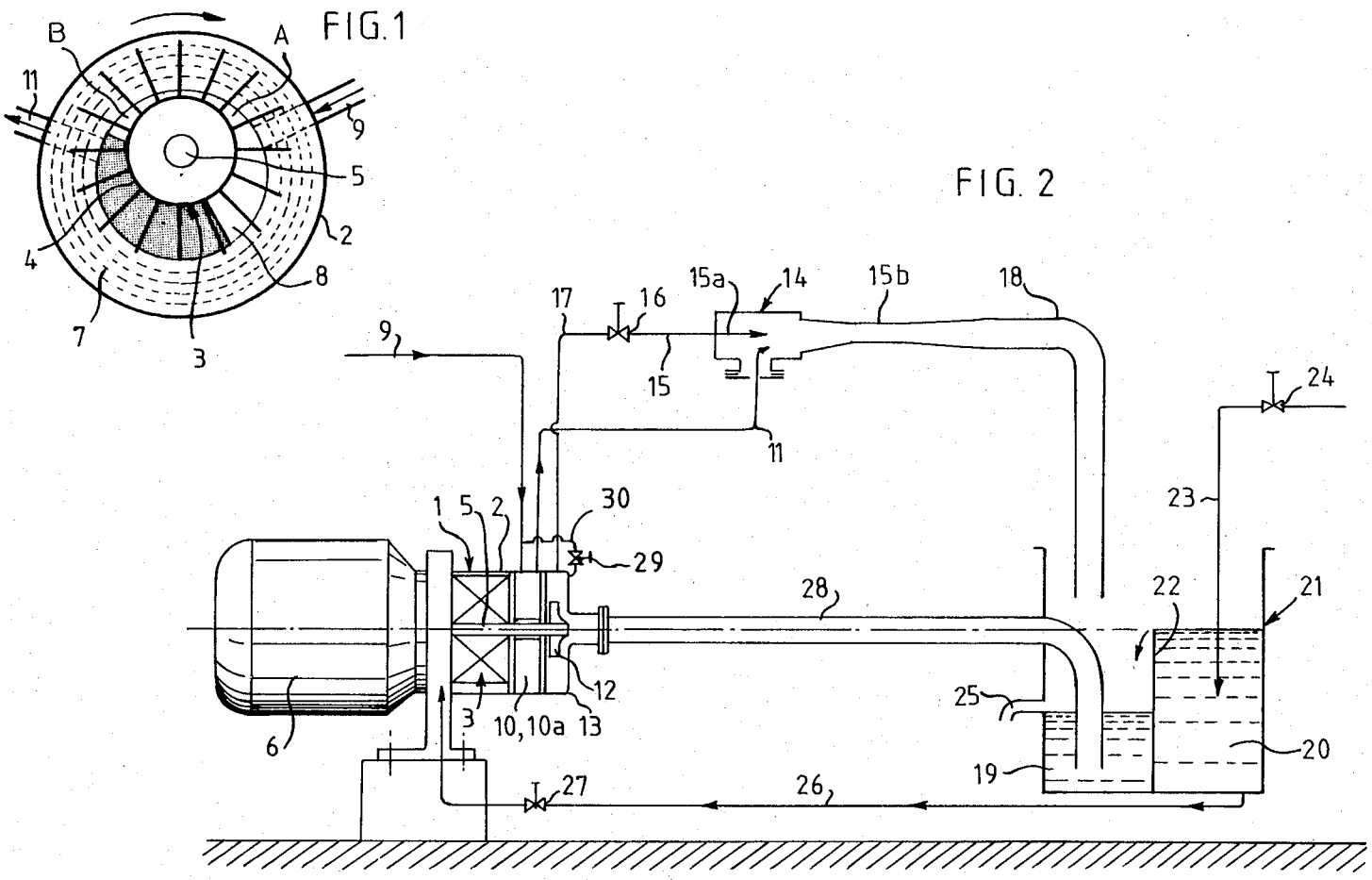
FIG. 1 is the schematical representation in section of a single stage liquid ring vacuum pump.
FIG. 2 is the schematical representation of a vacuum unit comprising a monobloc liquid ring vacuum pump (motor with flange coupling), this latter and the centrifugal pump being mounted on the same drive shaft (first variation of the invention)

The gas or air to be conveyed is therefore sucked in through a suction pipe 9 which opens into a suction chamber 10 (clear zone in FIG. 1) connecting with zone A, and discharged through a discharge duct 11 which opens into a discharge chamber **10*a* (dark zone in FIG. 1) communicating with zone B. For each revolution of the blade wheel 3, there is thus suction followed by discharge, which allows a certain amount of gas or air to be continuously sucked in under reduced pressure and continuously discharged at a higher pressure. As shown in FIG. 2, shaft 5 is extended and passes through the suction and discharge chambers 10, 10*a* and carries at its end the turbine 12 of a centrifugal pump 13 integral with the liquid ring pump 1**.

The discharge duct 11 of this latter is connected to the suction side of a water jet ejector 14 having a drive water input duct 15 terminating in a nozzle **15*a* and connected through a shut-off valve 16 to the delivery side duct 17 of the centrifugal pump 13. This nozzle 15*a* opens, in a way known per se, into the converging portion of a converging-diverging part 15*b* whose diverging part is extended by a discharge duct 18 ending above compartment 19 forming one of the two compartments 19,20 of a tank 21. The two compartments 19,20 are separated by a vertical wall 22 whose upper end is at the height of the axis of pump 1. Compartment 20 is supplied with cooling water through a duct 23 provided with a flow-rate regulating valve 24, the overflow from this compartment 20 flowing into compartment 19 where the water is maintained at a lower level than that in compartment 20, by means of an overflow device 25 provided in the lateral wall of tank 21**.

Compartment 20 is provided at its base with a duct 26 having a flow-rate regulating valve 27, in relation with the body of the liquid ring pump 1. Furthermore, the suction duct 28 of the centrifugal pump 13 plunges into the water of compartment 19.

Finally, the centrifugal pump 13 is connected by a duct 30 to the suction duct 9, a shut-off valve 29 being disposed in this duct 30; the shut-off valve 29 opens, preferably automatically, when the vacuum created in duct 9 reaches a certain threshold, this threshold being chosen so as to limit the power consumed by the installation during evacuation and corresponding to the vacuum able to be obtained with optimum efficiency by use alone of the liquid ring pump.

On start-up of the installation, the centrifugal pump 13 is generally unprimed; so no liquid is discharged into duct 17 and the liquid jet ejector 14 is inoperative. Consequently, when motor 6 is started up, the evacuation only occurs in the liquid ring vacuum pump 1. If, at start-up of the installation, the centrifugal pump 13 is already primed, the same result will be obtained by completely closing shut-off valve 16. When the vacuum created at the suction side 9 of the liquid ring pump 1 reaches the predetermined threshold, shut-off valve 29 is opened which causes centrifugal pump 13 to be primed and so the liquid jet ejector to be brought into operation. In the case where the centrifugal pump 13 is already primed but where shut-off valve 16 is closed, the liquid jet ejector 14 will be brought into operation by simply opening the shut-off valve 16. Then, the evacuation continues until the finally desired vacuum is reached.

In normal operation, the gas (air) at $8.333\times10^3$ Pa, for example, sucked in through duct 9 is discharged through duct 11 (e.g. at $28.867\times10^3$ Pa) then sucked in, at the same time as the fraction of the water for cooling the liquid ring pump which it carries along, through the water jet ejector 14 operating by means of the pressurized water coming from the discharge side duct 17 of the centrifugal pump 13. The gas (air)-water mixture from ejector 14 is then discharged through duct 18 as far as compartment 19 (at atmospheric pressure) where there is separation of the air(gas) and the water. This latter, mixed with the cooling water from compartment 20 and possibly from a cooling water make-up pipe (not shown), is then sucked in through the suction side duct 28 of centrifugal pump 13.

It should be further noted that the flow-rate of cooling water flowing in duct 26 is regulated by shut-off valve 27 so as to economize the cooling water on the one hand and/or to minimize the power consumed by the liquid ring pump on the other hand.

The adjustment of the desired vacuum or regulation of the power consumed depending on the displacement capacity of the assembly may be achieved in a very simple way by means of the manual or automatic shut-off valve 16 or else by varying, manually or automatically, the diameter of nozzle 15*a* of the water jet ejector 14.

It should be noted that duct 30 has a very small diameter so that, once the centrifugal pump 13 has been primed, there only escapes through this duct a quantity of water sufficiently small so as not to disturb the operation of the installation and particularly of the liquid ring pump.

It should finally be noted that it is possible to modify the installation which has just been described, without affecting the performances thereof in any way, by leaving out compartment 20, by connecting duct 26 to the water distribution network and by disposing a shut-off valve in duct 26, which valve shuts automatically when the liquid ring pump 1 stops and opens, still automatically, when the liquid ring pump 1 starts up again. In addition, or instead of this shut-off valve, there may be provided at the base of the liquid ring pump a discharge duct for the cooling liquid, which duct has a shut-off valve whose opening occurs automatically when said pump stops and which closes, still automatically, when this pump starts up again.

The invention of FIG. 3 is distinguished from that of FIG. 2 (a) in that the liquid ring pump 1 is mounted on a double ball-bearing 31, 32 and is rotated by a motor 6 coupled by a coupling sleeve 33 to one of the ends of shaft 5 of the liquid ring pump 1, the other end of shaft 5 being connected by a connector 34 to a step-up gear or speed variator 35 which allows the rotational speed of centrifugal pump 13 to be increased or reduced with respect to that of liquid ring pump 1 and so the pressure of the drive water for ejector 14 to be easily adjusted and consequently the best efficiency to be obtained, this step-up gear or variator 35 being connected to shaft 36 of centrifugal pump 13, (b) in that tank 21 is replaced by a single tank 37 connected by its lateral wall to the suction side duct 28 of the centrifugal pump 13 and provided with an overflow 38, this latter being situated at a higher level than that where the suction side duct 28 is connected to the lateral wall of tank 37, (c) in that duct 26 instead of being connected to the base of tank 37 is connected to an external pressurized cooling water distribution network (not shown), (d) in that the delivery side duct 17 of the centrifugal pump 13 is provided, upstream of shut-off valve 16, with a by-pass 39 in which is disposed a diaphragm 40 allowing in this by-pass 39 a small flow of water which flows into tank 37, (e) in that drive water input duct 15 ends in at least two nozzles 41 opening into the convergent-divergent portion 15*b*, each of these nozzles 41 being provided with a cut-off valve 42, the opening or closing of all or part of these valves 42 allowing the number of operational nozzles and so the extractive capacity of ejector 14 to be varied without lowering of efficiency and (f) in that an instantaneous opening or closing shut-off valve 43, preferably automatic, is disposed in the delivery side duct 11 of pump 1, a non-return valve 44 is disposed in by-pass 45 opening into the free air and connected to duct 11 upstream of shut-off valve 43 and a non-return valve 46 is disposed in a pipe 47 extending from the suction side duct 9 of pump 1 and joining duct 1 downstream of shut-off valve 43, non-return valve 44 being adapted so as to allow fluids to flow only in the direction from duct 11 to the free air and non-return valve 46 being adapted so as to allow fluids to flow only in the direction from duct 9 to duct 11.

At the beginning of evacuation, with centrifugal pump 13 primed and so operational, shut-off valve 43 is closed, valve 27 is opened to supply pump 1 sufficiently with cooling water, valve 16 and at least one of the cut-off valves 42 is opened and motor 6 is started up. Because of the pressures reigning at different points in the installation, non-return valves 44 and 46 open thus coupling in parallel pump 1 and ejector 14, which allows a more rapid evacuation than that obtained in the installation of FIG. 2. When the vacuum created reaches the predetermined chosen threshold (coupling point of ejector 14), shut-off valve 43 is opened (or it opens automatically if it has been designed to open when this predetermined vacuum is reached) resulting in the immediate closing of non-return valves 44 and 46 and the instantaneous coupling in series of pump 1 and ejector 14, whereafter the evacuation continues until the final desired vacuum is obtained. Of course, opening of valves 16 and 42 will be adjusted so as to consume the minimum power required.

The installation of FIG. 4 comprises, like the preceding installations, a first compression stage, formed by the liquid ring pump 1 actuated by motor 6 and supplied with cooling water through duct 26 carrying valve 27; on the other hand, the second compression stage is no longer formed by a liquid jet ejector, but by another liquid ring vacuum pump 48 actuated by a motor 49 and supplied with cooling water through a duct 50 having a flow regulation valve 51 and connected to an external pressurized cooling water distribution network (not shown). The delivery duct 11 of pump 1 is connected by an instantaneous opening or closing shut-off valve 52, preferably automatic, to the suction side 53 of pump 48, the delivery side 54 of this latter emerging in the open air. The delivery duct 11 carries, upstream of valve 52, a by-pass 55 opening to the atmospheric pressure, preferably through a water guard intended to form a hydraulic joint and formed by a tank 56 filled with water, open to the free air and into which the end of duct 55 plunges. In this by-pass is inserted a non-return valve 57 designed so as to allow fluids to flow only in the direction from duct 11 to the water guard.

At the beginning of evacuation, valve 52 is closed, motor 6 is started up and valve 27 is opened. The water-air mixture delivered by pump 1 causes non-return valve 57 to open. When the vacuum reaches a predetermined value (which corresponds preferably to the maximum vacuum able to be obtained with optimum efficiency by means of pump 1), motor 49 is started up and valves 51 and 52 are opened (this valve 52 opens automatically if it is designed so as to open when this predetermined vacuum is reached); the result is the instantaneous closing of non-return valve 57 and the coupling in series of pumps 1 and 48 which then work together until the final desired vacuum is reached. It should be noted that in the embodiment which has just been described, valve 52 could be replaced by a non-return valve designed so as to allow fluids to flow only in the direction from pump 1 to pump 48.

In accordance with the present invention, it is particularly advantageous to connect the suction side duct 9 of pump 1 to the suction side 53 of pump 48, downstream of valve 52, by means of a pipe 58 in which is inserted a non-return valve 59 designed so as to allow fluids to flow only in the direction from duct 9 to suction side 53. In this case, the installation operates in the following way. At the beginning of evacuation, the two pumps are dissociated by closing valve 52, motors 6 and 49 are started up and valves 27 and 51 are opened. The result is the opening of non-return valves 57 and 59 and the coupling in parallel of the two pumps, which allows an even faster evacuation than before. When the vacuum reaches the previously defined predetermined value, valve 52 is opened or opens automatically; the result is the instantaneous closing of non-return valves 57 and 59 and so the coupling in series of pumps 1 and 48 which then work together until the final desired vacuum is obtained.

It is known that the hydraulic efficiency of a liquid ring vacuum pump is all the better the slower the blade wheel of this pump rotates, especially beyond a certain sucked volume. Thus, if for example the volume sucked by pump 1 is 300 $m^3$/hour, and if the maximum vacuum is $8.333\times10^3$ Pa and the intermediate vacuum is $28.867\times10^3$ Pa, then the volume sucked by pump 48 is substantially 3.46 times smaller, i.e. ((300/346)≠87 $m^3$/h). Therefore, pump 1 may rotate at 1400 rpm with good efficiency and pump 48 may rotate at 2800 rpm also with good efficiency. The speed of 2800 rpm allows the dimensions and the cost price of the liquid ring pump forming the second stage to be reduced to a very great extent.

So, with respect to a two stage liquid ring vacuum pump, in which the two stages have the same dimensions, the installation of the invention which comprises a smaller second stage than the first one, is more economical.

It should be finally noted that the two vacuum pumps 1 and 48 may be actuated by the same motor 6; in this case, it is sufficient simply to omit motor 49 and to connect the shafts of these two pumps through a step-up gear or speed variator which allows pump 48, which is smaller than pump 1, to rotate at a speed greater than that at which pump 1 rotates.

It is understood that the structure and operation of valves 29, 43 and 52 are disclosed in U.S. Pat. No. 2,492,075, issued Dec. 20, 1949.

I claim:

1. An installation for rapidly evacuating an enclosure, comprising a first compression stage unit formed by a liquid ring vacuum pump; a second compression stage unit; each of said units including a suction duct and a discharge duct, the suction duct of the first compression stage unit being in connection with the enclosure to be evacuated, the discharge duct of the first compression stage unit being in communication with the suction duct of the second compression stage unit and the discharge duct of the latter being in communication with the atmosphere; and means for instaneously enabling the second compression stage unit to cooperate in series with the first compression stage unit when a predetermined reduced pressure has been established by the first compression stage unit in the enclosure to be evacuated and for instanteously preventing the second compression stage unit to cooperate in series with the first compression stage unit when the pressure in said enclosure is higher than said predetermined reduced pressure.

2. The installation as claimed in claim 1, wherein said second compression stage unit comprises a liquid jet ejector including a drive liquid input and further comprising a centrifugal pump including a suction side duct and a delivery side duct, the latter being in communication with the drive liquid input of said liquid jet ejector.

3. The installation as claimed in claim 2, further comprising a connecting duct connecting the discharge duct of said first compression stage unit to said suction duct of said second compression stage unit and wherein said enabling means comprises an instantaneous opening or closing shut-off valve disposed in said connecting duct, a first non-return valve disposed in a by-pass opening into atmosphere and connected to said duct upstream of said shut-off valve, and a second non-return valve disposed in a pipe extending from said suction duct of said first compression stage unit and joining said suction duct of the second compression stage unit downstream of said shut-off valves, said first non-return valve only allowing fluids to flow in the direction from said first compression stage unit to atmosphere, said second non-return valve only allowing fluids to flow in the direction from said suction duct of said first compression stage unit to said suction duct of said second compression stage unit.

4. The installation as claimed in claim 3, further comprising a drive shaft driving connected to both of said centrifugal pump and said liquid ring vacuum pump.

5. The installation as claimed in claim 3, wherein said centrifugal pump is directly mounted on the end of the driving shaft of said liquid ring vacuum pump.

6. The installation as claimed in claim 3, further comprising a liquid-gas separator in communication with said discharge duct of said liquid jet ejector and with said suction side duct of said centrifugal pump for returning all or part of the liquid collected in this separator to said centrifugal pump.

7. The installation as claimed in claim 6, wherein said liquid-gas separator is formed by a tank with two compartments, one provided with a cooling liquid supply pipe and in communication with the cylindrical body of said liquid ring vacuum pump, the flow of the cooling liquid supplying said compartment being greater than the flow of cooling liquid supplying said liquid ring vacuum pump, the other receiving, on the one hand, the liquid-gas mixture from said discharge duct of said liquid jet ejector and, on the other hand the overflow from the other compartment.

8. The installation as claimed in claim 3, wherein the cylindrical body of the liquid ring vacuum pump is in communication with a continuous cooling liquid source.

9. The installation as claimed in claim 1, characterized in that the second compression stage is formed by a single stage liquid ring vacuum pump.

10. The installation as claimed in claim 9, characterized in that said liquid ring pump forming the first stage and the liquid ring pump forming the second stage are driven by different motors, in which case the means for instantaneously enabling or preventing the second compression stage unit to cooperate in series with the first compression stage unit comprise a first non-return valve disposed in the duct connecting the delivery side of the first stage to the suction side of the second stage and a second non-return valve disposed in a by-pass opening to the free air and connected to said duct upstream of the first non-return valve, this latter only allowing fluids to flow in the direction from the first stage to the second stage and the second non-return valve only allowing fluids to flow in the direction from the first stage to the free air.

11. The installation as claimed in claim 9, characterized in that the liquid ring pump forming the first stage and the liquid ring pump forming the second stage are driven by the same motor, in which case the means for instantaneously enabling or preventing the second compression stage unit to cooperate in series with the first compression stage unit comprise an instantaneous opening or closing shut-off valve disposed in said duct connecting the delivery side of the first stage to the suction side of the second stage and a non-return valve disposed in a by-pass opening to the free air and connected to said duct upstream of said shut-off valve, said non-return valve only allowing fluids to flow in the direction from the first stage to the free air.

12. The installation as claimed in claim 9, wherein said means for instantaneously enabling or preventing the second compression stage unit to cooperate in series with the first compression stage unit comprises an instantaneous opening and closing shut-off valve disposed in the duct connecting the delivery side of the first stage to the suction side of the second stage, a first non-return valve disposed in a by-pass opening to the free air and connected to said duct upstream of said shut-off valve and a second non-return valve disposed in a pipe extending from the suction side of the first stage and joining the suction side of the second stage downstream of said shut-off valve, said first non-return valve only allowing fluids to flow in the direction from the first stage to the free air, the second non-return valve only allowing fluids to flow in the direction from the suction side of the first stage to the suction side of the second stage.

13. The installation as claimed in claim 3, wherein said centrifugal pump is mounted on the end of the driving shaft of the liquid ring vacuum pump through a speed variator.

* * * * *